US008610631B2

(12) United States Patent
Lindenmeier et al.

(10) Patent No.: US 8,610,631 B2
(45) Date of Patent: Dec. 17, 2013

(54) ANTENNA ROD FOR A ROD ANTENNA FOR MULTIPLE RADIO SERVICES

(75) Inventors: Stefan Lindenmeier, Gauting-Buchendorf (DE); Heinz Lindenmeier, Planegg (DE); Leopold Reiter, Gilching (DE); Jochen Hopf, Haar (DE)

(73) Assignee: Delphi Delco Electronics Europe GmbH (DE)

( * ) Notice: Subject to any disclaimer, the term of this patent is extended or adjusted under 35 U.S.C. 154(b) by 431 days.

(21) Appl. No.: 12/856,676

(22) Filed: Aug. 15, 2010

(65) Prior Publication Data

US 2011/0193755 A1 Aug. 11, 2011

(30) Foreign Application Priority Data

Aug. 17, 2009 (DE) ..... 10 2009 037 722

(51) Int. Cl.
*H01Q 1/32* (2006.01)

(52) U.S. Cl.
USPC ..... 343/715; 343/895; 343/900

(58) Field of Classification Search
USPC ..... 343/715, 711, 713, 749, 895, 873, 900
See application file for complete search history.

(56) References Cited

U.S. PATENT DOCUMENTS

| | | | | |
|---|---|---|---|---|
| 4,137,534 | A * | 1/1979 | Goodnight | 343/752 |
| 5,990,848 | A | 11/1999 | Annamaa et al. | |
| 2003/0137463 | A1* | 7/2003 | Shimizu | 343/713 |
| 2011/0193755 | A1* | 8/2011 | Lindenmeier et al. | 343/715 |

FOREIGN PATENT DOCUMENTS

| | | | |
|---|---|---|---|
| EP | 0790666 | | 8/1997 |
| EP | 1926175 | | 5/2008 |
| GB | 2400497 | A * | 10/2004 |
| GB | 2410837 | | 8/2005 |
| JP | 10242740 | | 9/1998 |
| WO | 0111721 | | 2/2001 |

OTHER PUBLICATIONS

European Search Report dated Mar. 8, 2012.
European Search Report dated Dec. 14, 2010.

* cited by examiner

*Primary Examiner* — Daniel D Chang
(74) *Attorney, Agent, or Firm* — J. Gordon Lewis

(57) ABSTRACT

An antenna rod for a rod antenna arrangement on a vehicle body, which serves as the ground of the rod antenna arrangement, for electromechanical connection with the electromechanical base connector of a low plastic base part. This base connector is affixed to the vehicle body which part contains the further antenna circuit that is connected to the electromechanical base connector. The antenna rod contains a plastic rod to which an antenna coil is applied. At the lower end of the plastic rod and parallel to its rod axis, an extended electrically conductive element is guided as a coupling conductor, for electromagnetic coupling to the antenna coil, with an overlap of multiple but at least two windings of the antenna coil. The coupling conductor is galvanically separated from the antenna coil by means of a low-loss insulator, to create capacitive coupling to the antenna coil. The coupling conductor, the low-loss insulator, and the antenna rod are connected with one another in mechanically firm manner. The coupling conductor is equipped, at its lower end, with an electromechanical connecting element, for connecting to the electromechanical base connector.

18 Claims, 10 Drawing Sheets b)

ANTENNA ROD FOR A ROD ANTENNA FOR MULTIPLE RADIO SERVICES

CROSS REFERENCE TO RELATED APPLICATIONS

This application hereby claims priority under 35 U.S.C. 119 from German Application Serial No. DE1020090377220 filed on Aug. 17, 2009, the disclosure of which is hereby incorporated herein by reference.

BACKGROUND

At least one embodiment of the invention relates to an antenna rod for a rod antenna on a motor vehicle, to be affixed and electrically connected with the electromechanical base connector of a low plastic base part attached to the vehicle body. In at least one embodiment, this antenna contains the further antenna circuit that is connected with the electromechanical base connector, which connector is connected to a plastic rod on which an antenna coil is affixed.

One antenna rod is known, for example, as a short-rod antenna, from DE 102004053354A1, particularly for radio reception in motor vehicles. This antenna rod is a short aerial, especially a vehicle radio aerial, that comprises a pedestal (2) and a shaft (3). The pedestal is located on the vehicle body work and is flexible, while the shaft is rigid. The shaft connection point is directly on the switching module via a connection line.

The antenna rod is attached to a plastic part and forms the high frequency HF radiator. Provisions are made to configure the winding at differentiated pitch, in order to utilize the shaft not only for the frequencies of radio but also for operation in the frequencies of mobile telephony—in the 900 MHz and in the 1.8 GHz range.

For use in motor vehicles, the construction height of such antennas is of particular importance. They are preferably used on the roof of the vehicle and represent a hindrance if their length is too long, particularly in parking garages having a low construction height and so-called double-parkers.

The radiator bandwidth of electrically short rod antennas increases by approximately cubing the length of the antenna rod with reference to the free-space wavelength of the operating frequency. In contrast to the conditions that prevail in the frequency range of AM radio, this law represents a particular difficulty, when designing very short rod antennas, in the frequency range of USW radio at a bandwidth of approximately 20 MHz, in connection with the ambient noise that is already low in this frequency range. The term USW can include the FM broadcast band or other bands known in the art. Antennas according to the state of the art generally possess a length of 40 cm. In addition, there is the demand for being able to produce such antenna rods, which are subject to particularly great cost pressure in vehicle technology, as cost-advantageously as possible.

It is therefore the task of one embodiment of the invention to indicate an antenna rod that on the one hand, that delivers the greatest possible reception voltage in the frequency range of ultra short wave USW radio, at the smallest possible length, and also allows operation for the radio services at higher frequency, as well as particularly cost-advantageous production.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

Figure 1D:
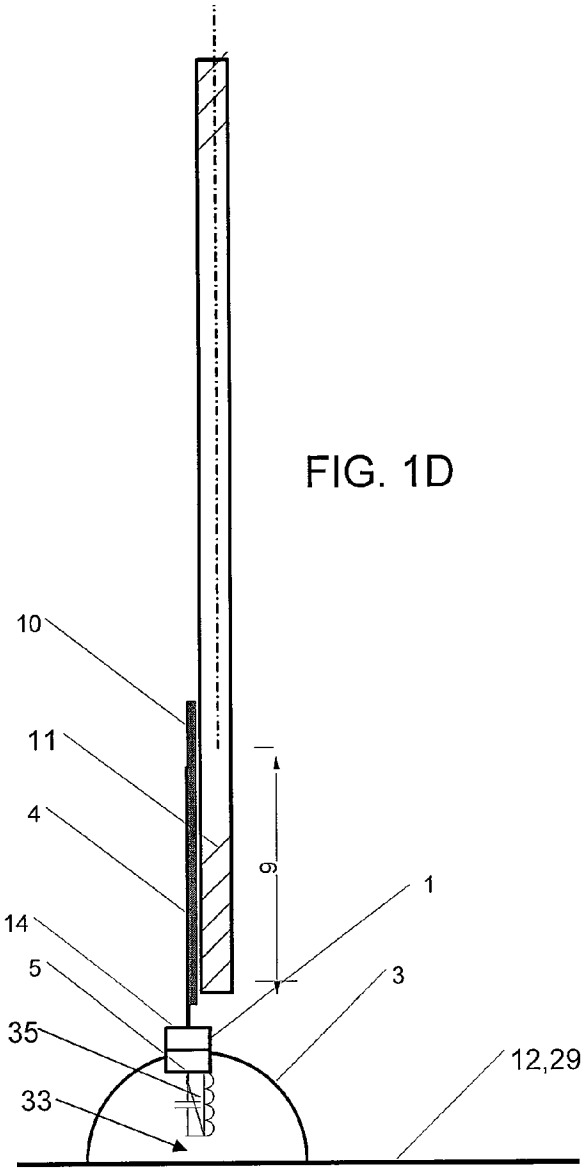
Figure 1A:
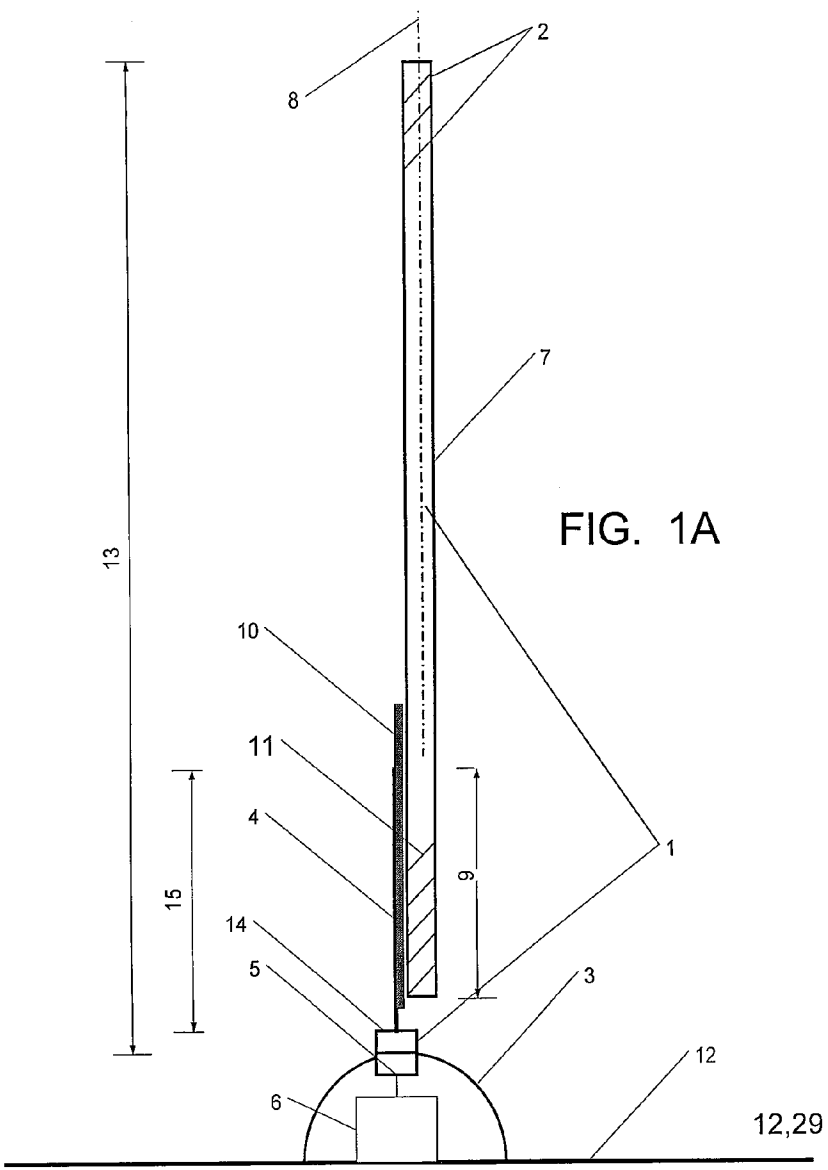
Figure 1B:
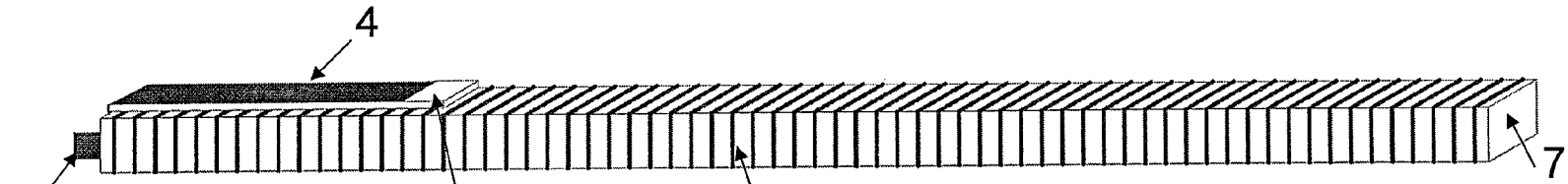
Figure 1C:
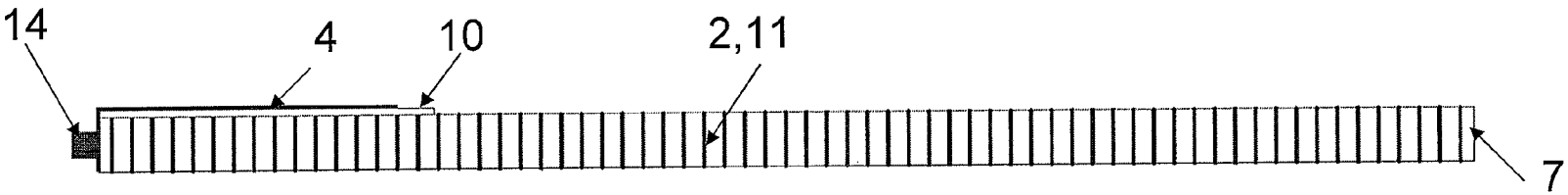
Figure 2:
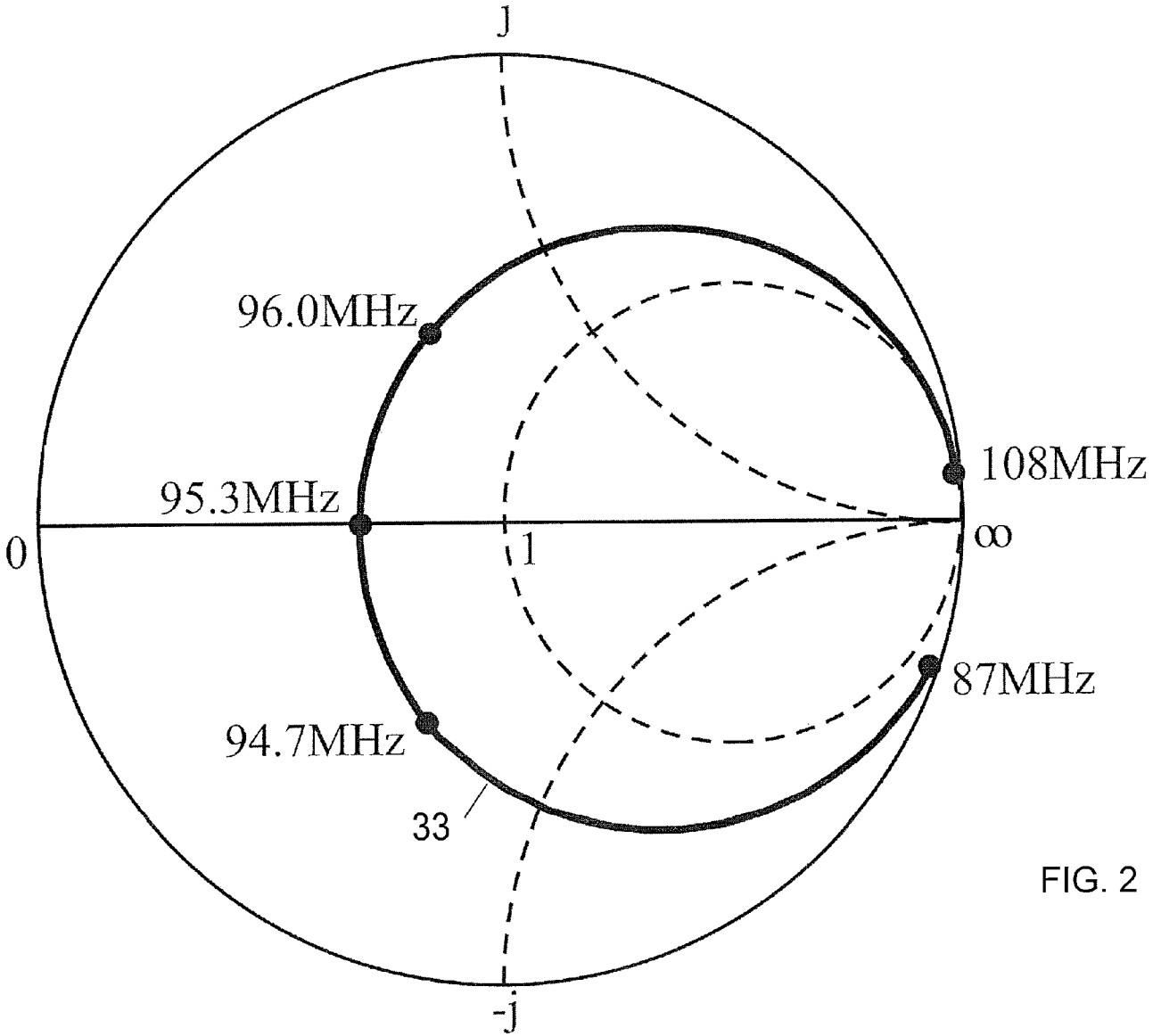
Figure 3:
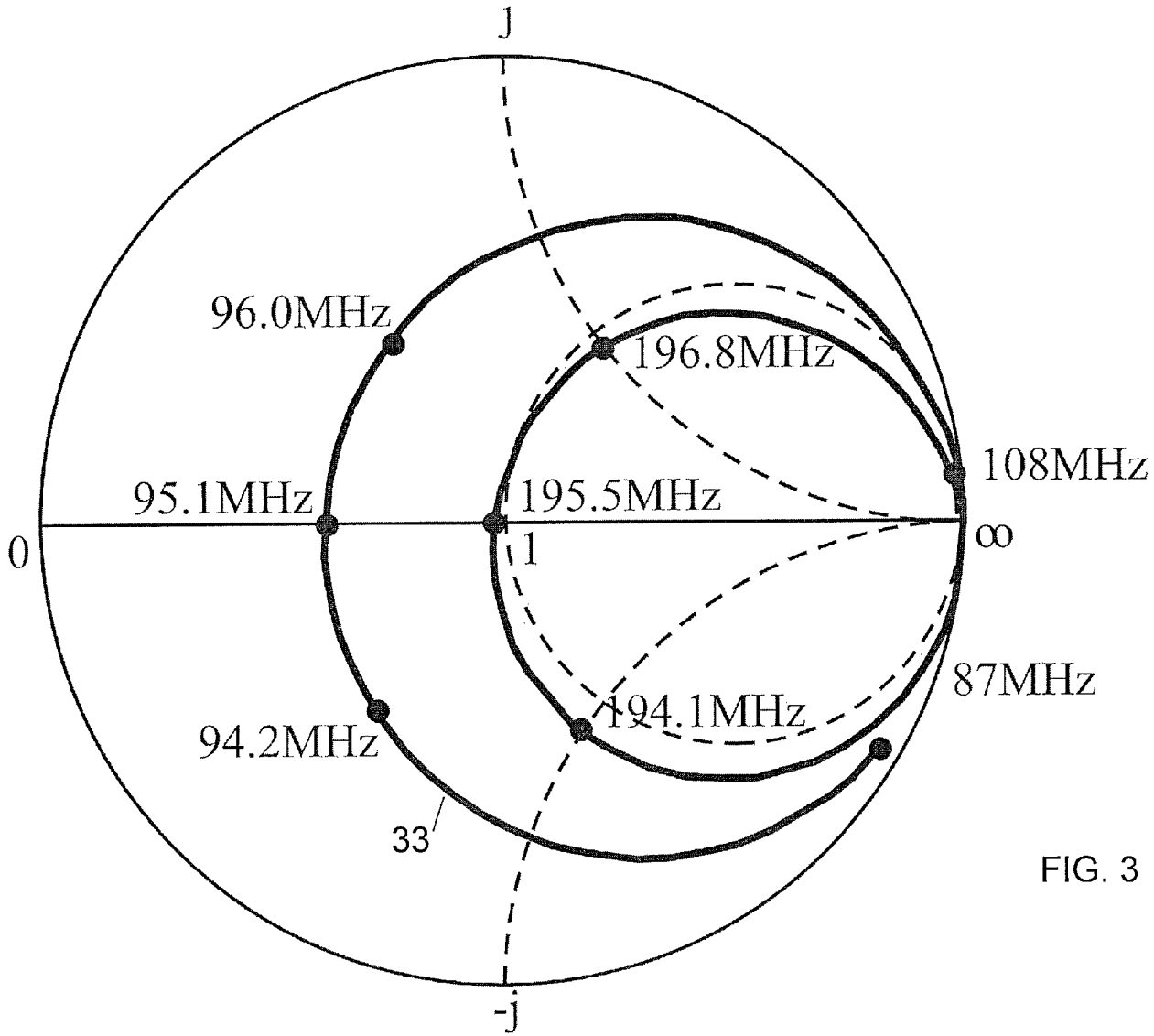
Figure 4B:
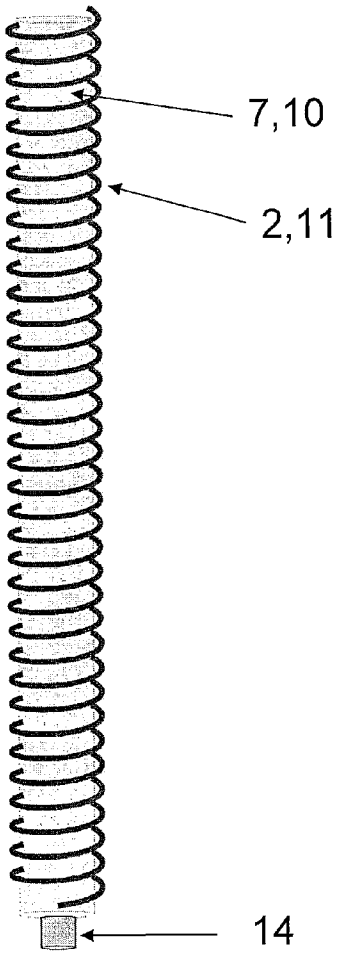
Figure 4A:
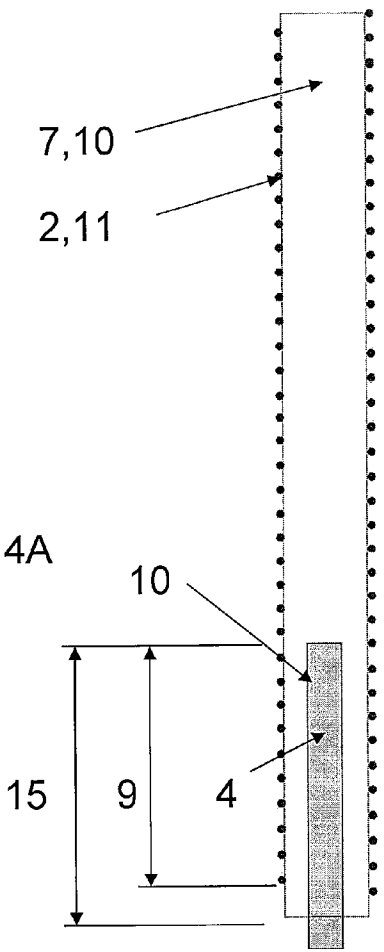
Figure 5A:
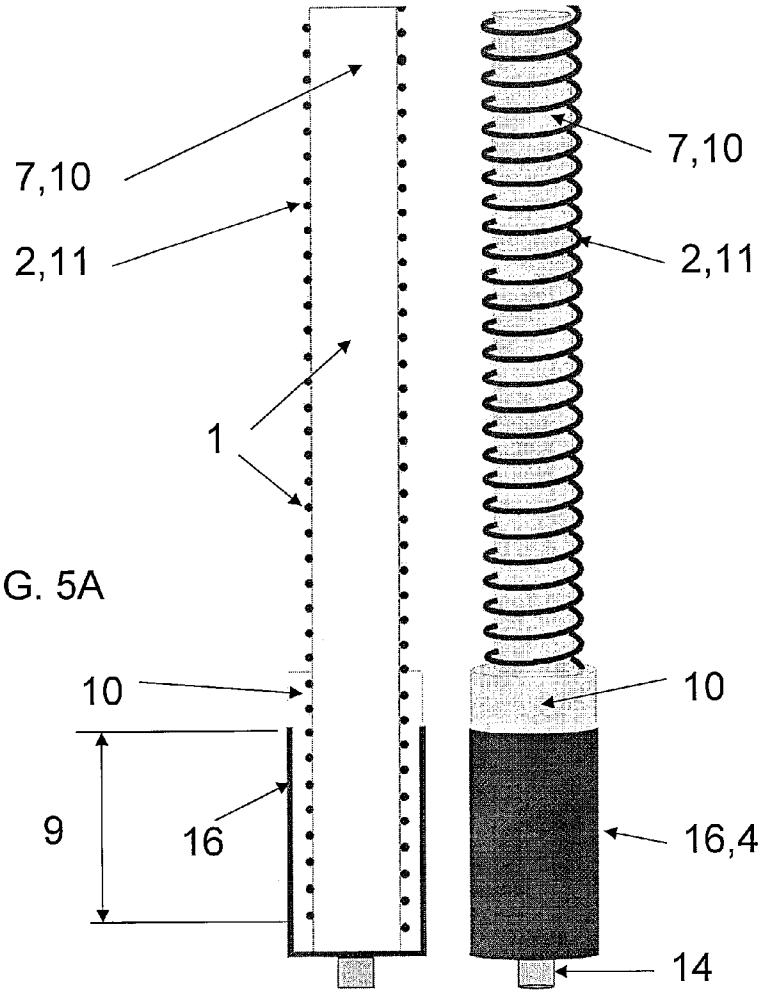
Figure 5B:
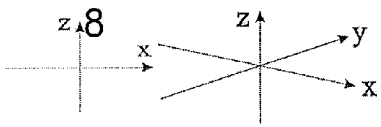
Figure 6A:
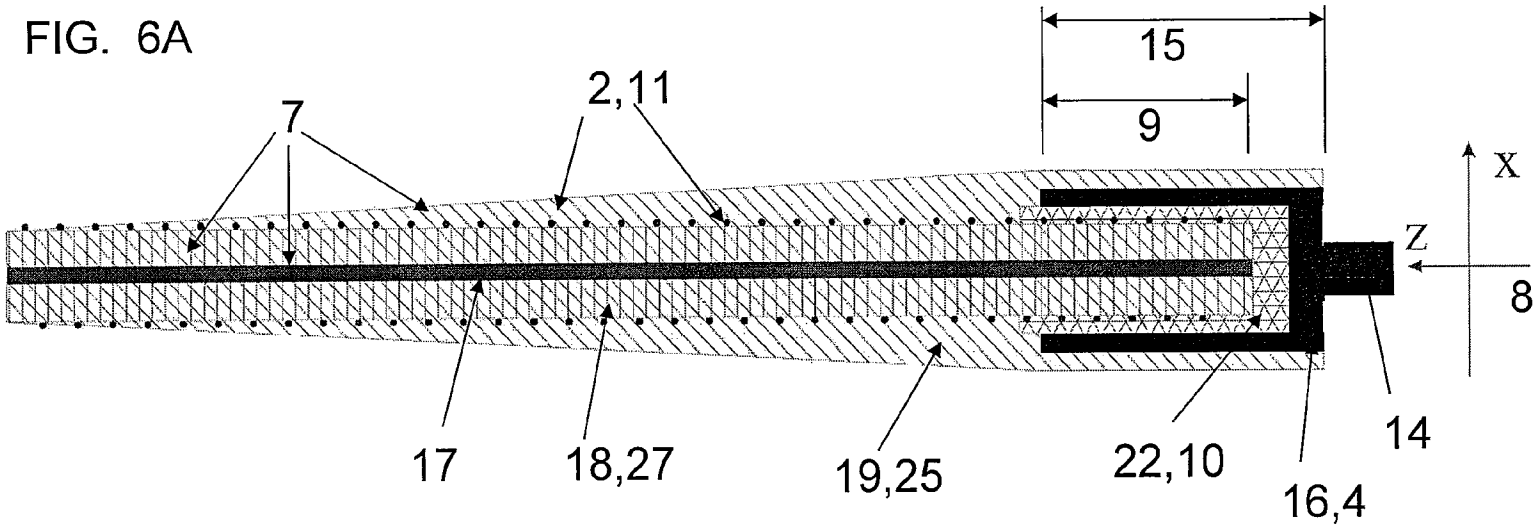
Figure 6B:
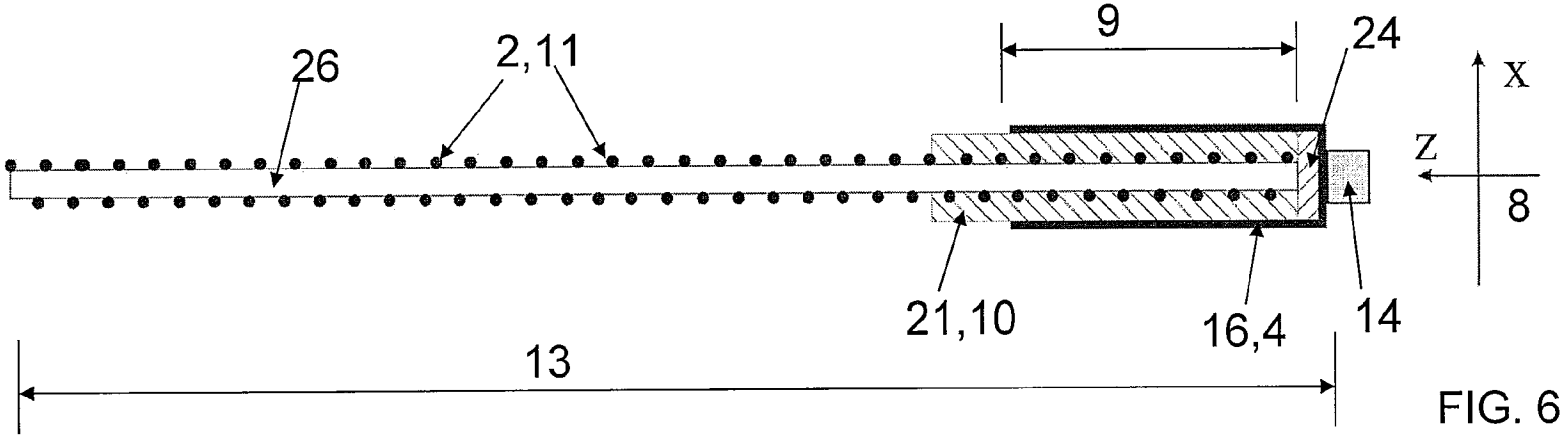
Figure 6C:
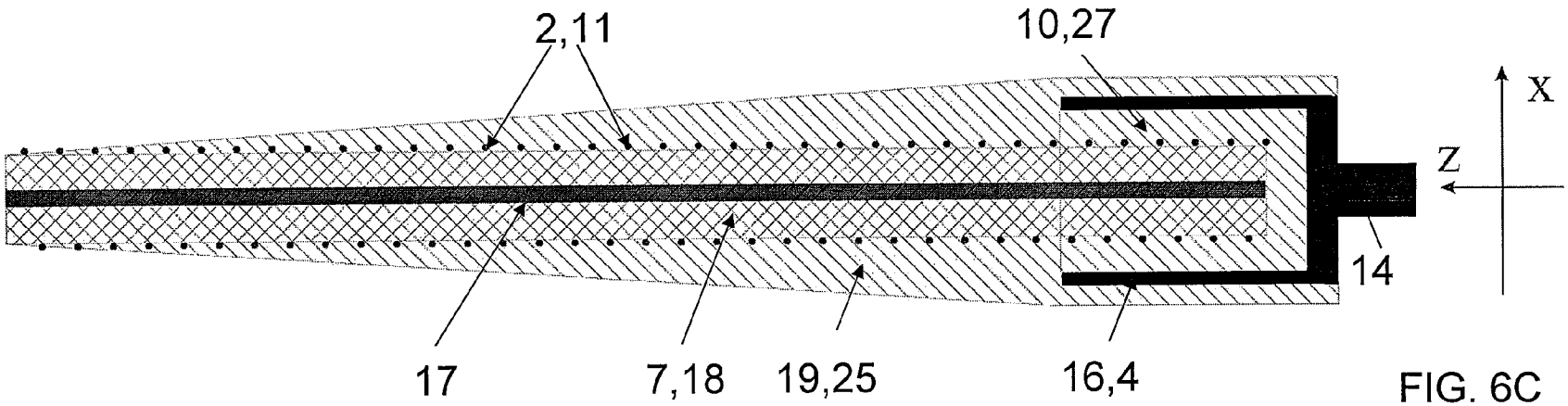
Figure 7A:
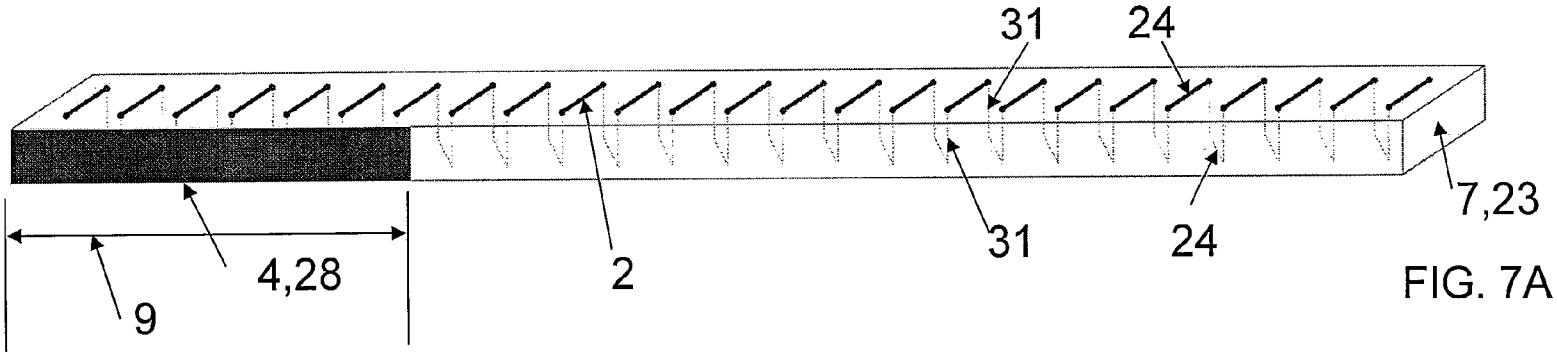
Figure 7B:
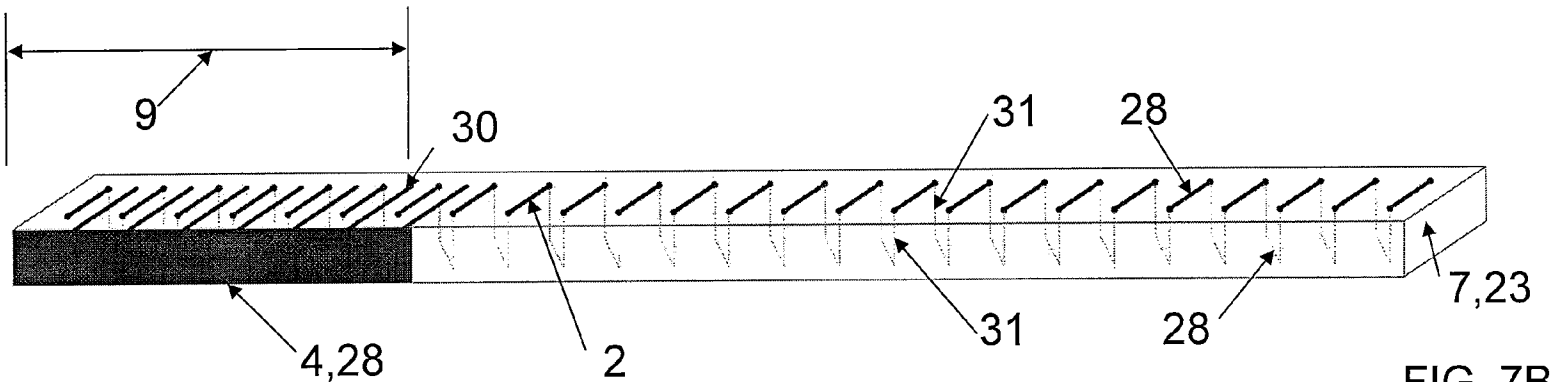
Figure 7C:
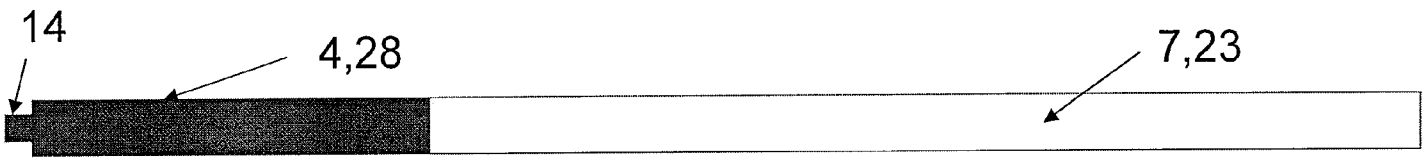
Figure 8B:
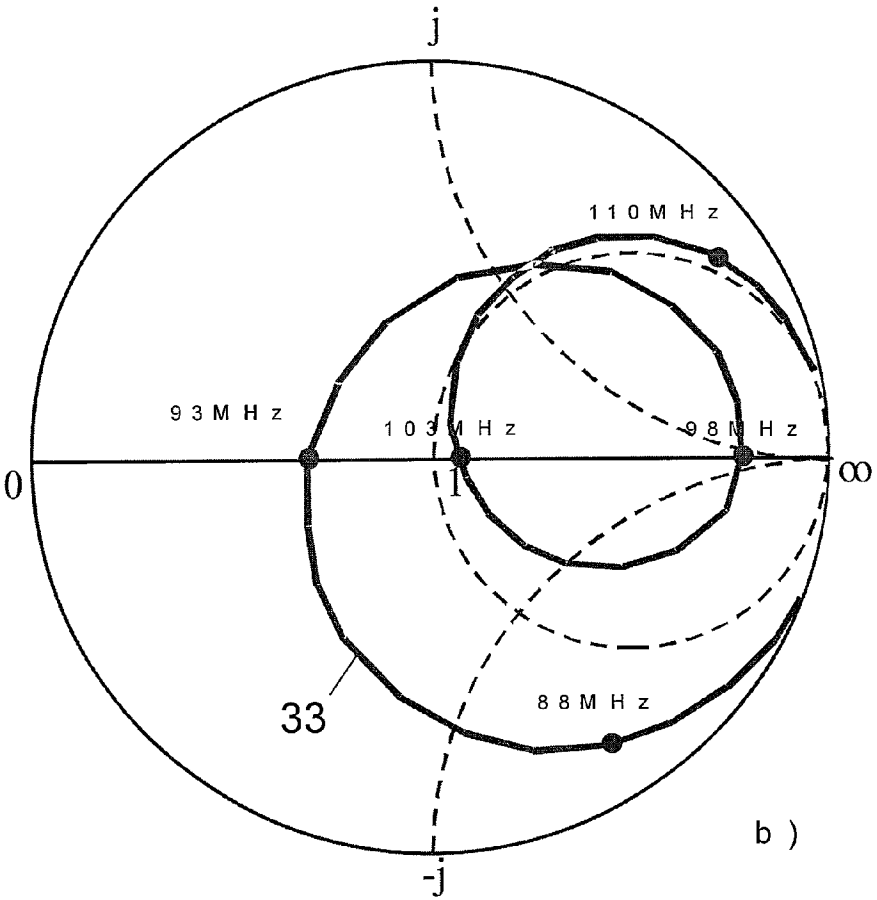
Figure 8A:
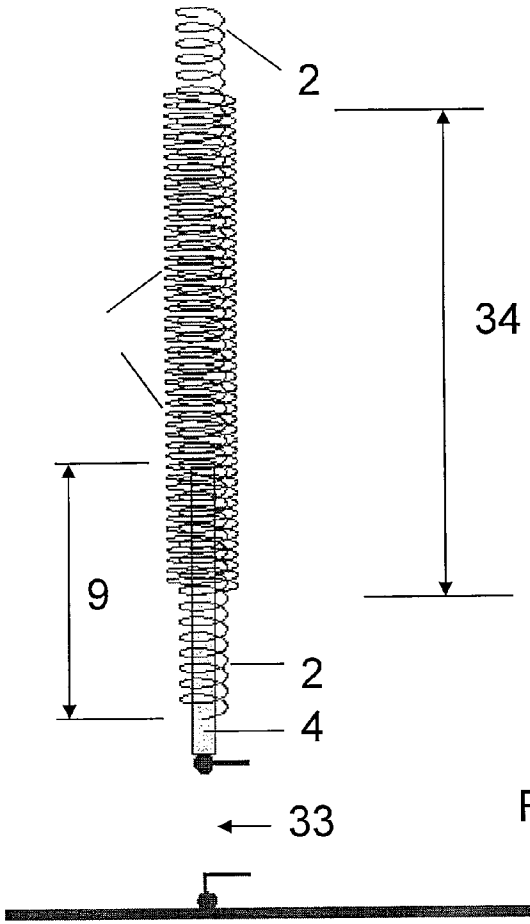

Exemplary embodiments of the invention are shown in the drawing and will be explained in greater detail in the following. In detail, the figures show:

FIG. 1A is a side cross-sectional view of an antenna and its coupler;

FIG. 1B perspective representation of the antenna rod, configured essentially with a rectangular cross-section, with a coupling conductor configured as a strip conductor;

FIG. 1C is a longitudinal section through the antenna rod, with representation of the electromechanical connecting element in a firm electrical connection with the coupling conductor;

FIG. 1D is a side cross-sectional view of another embodiment of the antenna and its coupler;

FIG. 2 is chart of a frequency-response-curve of the impedance of the antenna rod connected with the electromechanical base connector measured against ground in frequency range between 87 MHz and 108 MHz wherein the impedance of the antenna rod connected with the electromechanical base connector is measured without further antenna circuit 6 being connected to base connector;

FIG. 3 is chart of a frequency-response-curve of the impedance 33 measured at one end of a parallel oscillating circuit as in FIG. 1D, wherein the impedance is measured without additional further antenna circuit being connected to this one end of a parallel oscillating circuit;

FIG. 4A is a side cross-sectional view of another embodiment which is similar to an antenna rod as in FIG. 1A, but with a coupling conductor in the shape of a round rod;

FIG. 4B is the side view of the embodiment of FIG. 4A;

FIG. 5A is a side cross-sectional view of another embodiment similar to that shown in FIG. 1A but further comprising an electrically conductive sleeve;

FIG. 5B is a side view of an antenna rod as in FIG. 5A, whereby, however, the coupling conductor is configured as an electrically conductive sleeve;

FIG. 6A is a side view of an antenna rod as in FIG. 5, but having a low-loss insulator configured as a sleeve;

FIG. 6B is a side view of an antenna rod as in FIG. 5, but having a plastic rod made of fiberglass-reinforced plastic having a round cross-section;

FIG. 6C is an antenna rod, as in FIG. 6A, having a the low-loss insulator formed by the material for the plastic protective sheathing;

FIG. 7A is an antenna coil as a printed circuit track on both sides of an extended printed circuit board;

FIG. 7B is an antenna coil as in FIG. 7A, but with additional capacitive coupling of the coupling conductor with an interdigital structure to increase the coupling capacitance;

FIG. 7C is a side view of the printed plastic rod in FIGS. 7A and 7B, with representation of the electromechanical connecting element;

FIG. 8A is a side view of an antenna according to at least one embodiment of the invention, with an additional coupling coil to increase the bandwidth; and FIG. 8B is a chart of a frequency-response-curve of an impedance of an antenna rod according to at least one embodiment of the invention, configured in accordance with FIG. 8A.

DETAILED DESCRIPTION

At least one embodiment of the invention will be discussed below briefly in summary and then discussed in greater detail after this brief summary.

FIG. 1A is a side view of an antenna rod 1 according to one embodiment of the invention, with an extended electrically conductive element as a coupling conductor 4 for electromagnetic coupling to the antenna coil 2 by way of the low-loss insulator 10, over the length of the overlap 9, to increase the reception voltage of the antenna rod in the USW frequency range. This design is coupled to base connector 5 and which is attached to antenna circuit 6. The base connector 5 is coupled to vehicle body 12. A low loss insulator for high frequency applications would be one where the losses are not greater than the rod antenna. The low loss insulator acts as a capacitor which is valid for RF applications. An example of a low loss insulator could be a polymer such as Teflon® or a ceramic.

FIG. 1B is a perspective representation of the antenna rod 1, configured essentially with a rectangular cross-section, with a coupling conductor 4 configured as a strip conductor.

FIG. 1C, is a longitudinal section through the antenna rod 1, with representation of the electromechanical connecting element 14 in a firm electrical connection with the coupling conductor 4.

FIG. 1D is an antenna rod 1 as in FIG. 1A, but with parallel oscillating circuit 35 for measuring the impedance 33 with two low-ohm resonance points.

FIG. 2 is a frequency-response-curve of the impedance 33 of the antenna rod 1 connected with the electromechanical base connector 5, measured against ground 29, in the frequency range between 87 MHz and 108 MHz, with low-ohm resonance at 95.3 MHz. The antenna rod 1 is tuned to the frequency range of USW radio. This resonance can have the character of a series resonance circuit.

FIG. 3 is a frequency-response-curve of the impedance 33 measured at one end of a parallel oscillating circuit 35—as in FIG. 1D—connected with the electromechanical base connector 5 with its other end, with the parallel resonance frequency between 120 MHz and 160 MHz, against ground 29. The antenna rod 1 and the parallel oscillating circuit 35 are tuned to one another in such a manner that a first low-ohm or impedance resonance occurs in the USW range, and a second one occurs in the VHF range. This low impedance resonance has the character of a series resonance circuit.

FIGS. 4A and 4B show is an antenna rod 1 as in FIG. 1A, but with a coupling conductor 4 in the shape of a round rod, introduced into the plastic rod 7, which is configured in tubular shape, over the length of the overlap 9. The low-loss insulator 10 is provided by the tube wall of the plastic rod 7.

FIGS. 5A and 5B show an antenna rod 1 as in FIG. 1A, whereby, however, the coupling conductor 4 is configured as an electrically conductive sleeve having an electromechanical base connector 5, into which sleeve the plastic rod 7 that carries the antenna coil 2 is inserted with the length of the overlap 9. The mechanically firm connection between the sleeve 16 and the plastic rod 7 is provided by way of the low-loss insulator 10, which is configured in tubular shape.

FIG. 6A with an antenna rod 1 as in FIG. 5, but having a low-loss insulator 10 configured as a sleeve, and having a plastic rod 7 configured from an elastic rod core 17 having a rod core sheathing 18 made of a softer plastic, and the plastic protective sheathing 25.

FIG. 6B is an antenna rod 1 as in FIG. 5, but having a plastic rod 7 made of fiberglass-reinforced plastic having a round cross-section, on which the wire-shaped conductor 11 of the antenna coil 2 is applied. The insulation disk 24 is inserted between the low-loss, tubular insulator 21 and the electrically conductive sleeve 16.

FIG. 6C is an antenna rod 1 as in FIG. 6*a*, whereby, however, the low-loss insulator 10 is formed by a material 27 for the plastic protective sheathing 25, which is selected to be insulating in dielectrically low-loss manner, by allowing this material 27 to flow in between the electrically conductive sleeve 16 and the plastic rod 7 that carries the antenna coil 2, when the plastic protective sheathing 25 is injection-molded around the antenna rod.

FIG. 7A is an antenna coil 2 as a printed circuit track 28 on both sides of an extended printed circuit board 23 formed as a plastic rod 7, in a perspective representation. The sections of the printed circuit tracks 28 assigned to one another on both sides are conductively connected with one another using interlayer connections 31. The coupling conductor 4, which is structured as a printed circuit track 28, is capacitatively coupled with the interlayer connections 31.

FIG. 7B is an antenna coil 2 as in FIG. 7A, but with additional capacitive coupling of the coupling conductor 4 with an interdigital structure 30 to increase the coupling capacitance between the coupling connector 4 and antenna coil 2.

FIG. 7C is a side view of the printed plastic rod 7 in FIGS. 7A and 7B, with representation of the electromechanical connecting element 14.

FIG. 8A is an antenna according to at least one embodiment of the invention, with an additional coupling coil 32 to increase the bandwidth. With suitable dimensions, it is possible to achieve a frequency-response-curve of an impedance corresponding to a two-circuit resonance band filter. For this purpose, the coil overlap 34 should not be less than ¼ the length of the antenna coil 2.

FIG. 8B is a frequency-response-curve of an impedance of an antenna rod 1 according to at least one embodiment of the invention, configured in accordance with FIG. 8A.

Thus, FIG. 1A shows an essentially vertical antenna rod 1 according to at least one embodiment of the invention, for a rod antenna arrangement on a vehicle body 12. The vehicle body 12 serves as a ground 29 of the rod antenna arrangement. Antenna rod 1 contains a plastic rod 7 on which an antenna coil 2 is applied. According to at least one embodiment of the invention, coupling to the coil 2 takes place by way of a coupling conductor 4 that consists of an extended, electrically conductive element, and is guided parallel to the rod axis 8 of the antenna rod 1.

The coupling conductor 4 is guided to be galvanically separated from the antenna coil 2 over the length of an overlap 9, by way of a low-loss insulator 10 disposed in between, and over an overlap 9 of multiple but at least two windings of coil 2, so that capacitative coupling to antenna coil 2 which exists over this length. The coupling conductor 4, the low-loss insulator 10, and the antenna rod are connected with one another in mechanically firm manner, and wherein a lower end of the coupling conductor 4, is equipped with an electromechanical connecting element 14 for a connection to the electromechanical base connector 5.

An antenna rod 1 of this type is generally connected with the electromechanical base connector 5 of a low plastic base part 3, attached to the vehicle body 12. This part contains the further antenna circuit 6, which is connected with electromechanical base connector 5. In this connection, an antenna rod according to at least one embodiment of the invention possesses the advantages, as compared to those according to the state of the art, that an increase in the reception voltage of the antenna rod 1 in the USW (ultra short wave) frequency range can be achieved by means of the combination of the capacitive coupling of the coupling conductor 4 with the antenna coil 2, by way of the low-loss insulator 10, over the length of the overlap 9.

With the distributed capacitance that exists over the length of the overlap 9 at the windings of the antenna coil 2, a transformation of the impedance 33 of the antenna rod 1 toward larger values is produced. The increase in the real part of this impedance 33, which essentially represents the radiation resistance, leads to this desired increase in the reception voltage.

If the antenna rod 1 is connected with the electromechanical base connector 5, then the frequency-response-curve of the impedance 33 in the USW frequency range that occurs against ground 29—which is provided by the vehicle body 12—and is shown in FIG. 2. The impedance 33 shown holds true for an antenna rod length 13 of h=15 cm and demonstrates a low-ohm resonance of the complex impedance 33 having the nature of a serial resonance of a damped oscillation circuit. This holds true if the winding number of the antenna coil 13, the overlap 9, and the capacitance between the coupling conductor 4 and the antenna coil 2 are suitably coordinated or tuned in the USW frequency range, at the frequency f=95.3 MHz. However, a significantly greater effective proportion of the impedance 33 occurs, because of the capacitive coupling of the coupling conductor 4, by way of multiple windings, to the antenna coil 2, than what would be produced with a simple antenna coil without this capacitive coupling, with an antenna rod length 13, with reference to the wavelength λ, at h/λ=0.05. This increased radiation resistance is advantageously increased in a broad frequency range around the passage point of the impedance 33 in the frequency point of the low-ohm resonance, thereby producing an increase in the reception voltage at a relatively great frequency bandwidth.

In the example shown, the length of the overlap 9 is selected to be 5 cm, and it should generally amount to at least 2 cm and maximally 6 cm. At a total number of about 200 of the windings having a constant pitch, an overlap 9 of about 60 windings has proven to be practical. Furthermore, it furthermore proves to be practical to configure the static capacitance between the coupling conductor 4 and the antenna coil 2 to be sufficiently large and not smaller than 3 pF.

In general, tuning of the antenna rod should advantageously be undertaken so that the low-ohm resonance occurs in the frequency range between 75 MHz and 110 MHz. A significant advantage connected with at least one embodiment of the present invention, in low-effort production of the antenna rod, results from the firm mechanical connection between the coupling conductor 4, the low-loss insulator 10, and the antenna rod. For an electrical and mechanical connection with the electromechanical base connector 5 of the plastic base part 3, the coupling conductor 4 is equipped with an electromechanical connecting element 14 at its lower end. According to at least one embodiment of the invention, there is therefore no galvanically conductive connection between the antenna coil 2 and the connector to the further antenna circuit 6. The plastic rod 7 that carries the antenna coil 2 can thus be produced in endless manner, for example, cut into appropriate lengths, and completely sheathed with an insulation material, and can be combined with the coupling conductor 4—without soldering—to form the antenna rod 1, for example by means of gluing.

FIG. 1B shows the perspective representation of an antenna rod 1 according to one embodiment of the invention, which is configured essentially with a rectangular cross-section. For capacitive coupling, the coupling conductor 4 is advantageously configured as a flat strip conductor. In FIG. 1*c*, the longitudinal section of the antenna rod 1 is shown, with representation of the electromechanical connecting element 14 in a firm electrical connection with the coupling conductor 4.

A particular advantage of an antenna rod 1 according to one embodiment of the invention is its particular suitability for low-effort configuration for multiple radio services. An advantageous increase in the reception voltage in the USW frequency range that can be achieved with at least one embodiment of the present invention can also be advantageously utilized if the antenna rod 1 is configured for a rod antenna arrangement for additional reception of VHF radio signals. If the antenna rod 1 is connected with the electromechanical base connector 5 of the plastic base part 3, as was described in connection with FIG. 1A, and if a parallel oscillating circuit 35 having the parallel resonance frequency between 120 MHz and 160 MHz follows the electromechanical base connector 5, as shown in FIG. 1D, then tuning of the antenna rod 1 and of the parallel oscillating circuit 35 can be configured so that, in each instance, the impedance 33 that can be measured between the free end of the parallel oscillating circuit 35 and the ground 29 possesses the frequency-response-curve shown in FIG. 3.

For this purpose, it is necessary, according to at least one embodiment of the invention, that the impedance 33 passes through a first low-ohm resonance in the frequency range between 75 MHz and 110 MHz for operation in the USW frequency range, and through a second low-ohm resonance in the frequency range between 175 MHz and 240 MHz, for operation in the VHF frequency range.

With a very small antenna rod length 13 of h=15 cm and less, the diameter, the pitch of the windings, and the diameter of the wire-shaped conductor 11 of the antenna coil 2 are coordinated or tuned with one another for reception of the FM and VHF radio band. This coordination or tuning takes place in such a manner that when a serial circuit composed of a capacitor and an inductor is inserted between the base connector 5 and the ground 29, the impedance measured parallel to the inductance passes through a low-ohm resonance in the frequency range between 190 MHz and 230 MHz.

The inductance should advantageously be selected so that when this circuitry is used in the further antenna circuit 6, the necessary bandwidth occurs in these frequency ranges, in each instance, both in the frequency range of FM radio and that of VHF radio, when an FM/VHF antenna amplifier is connected, having a high-ohm field effect transistor parallel to the inductor, on the input side. For this purpose, the capacitor for passing on the signals in these frequency ranges should be selected to be sufficiently large, but on the other hand not too large, in order to not overly weaken these signals when an AM amplifier having a high-ohm field effect transistor on the input side at the input of the AM amplifier is connected between the base connector 5 and the ground 29. Advantageous values for such a capacitor lie between 5 pF and 20 pF; advantageous values for the inductor lie between 500 nH and 1500 nH.

In another advantageous embodiment of the invention, in a variation of the design of FIGS. 1A and 1D, the coupling conductor 4 is configured for forming an antenna rod 1 for a rod antenna arrangement for reception of AM/FM/VHF and radio service in the L band. The length of the coupling conductor 15 for reception of a radio service in the L frequency band is selected to be about ¼ of the free-space wavelength of the frequency of the radio service. The slight pitch of the wire coil that is required for tuning of the antenna coil 2 leads to a high-ohm structure in the frequency range of the L frequency band, which structure has hardly any influence on the radiation behavior of the coupling conductor 4, which is configured as an L-band radiator.

An antenna rod 1 configured in this advantageous manner allows inclusion of the radio band in the L frequency band with a correspondingly broadband configuration of the aforementioned FM/VHF antenna amplifier as an FM/VHF/L-band amplifier. The antenna rod 1 configured in this manner allows reception of all radio bands AM, FM, VHF, and L band, at the aforementioned advantageous small antenna rod length 13, by means of frequency-selective joining of the output signals of the FM/VHF/L-band amplifier and of the AM amplifier in a further antenna circuit 6.

FIGS. 4A and 4B show another advantageous embodiment of the invention, wherein the plastic rod 7 is configured in tubular shape in its lower section, at least over the length of the overlap 9. The coupling conductor 4 which is configured in the shape of a round rod, is introduced into the plastic rod 7, which is configured in tubular shape, and connected with the latter in mechanically firm manner. In this connection, a low-loss insulator 10 is formed, in tubular manner, by means of a tubular plastic rod 7 itself. At its lower end, this coupling conductor 4 is connected with the electromechanical connecting element 14. In an advantageous embodiment, the entire plastic rod 7 is tubular, and has a wire-shaped conductor 11 having a constant pitch or angle wound onto it, to form the antenna coil 2. In this form, as well, the plastic rod 7 that carries the antenna coil 2 can be produced in endless manner, for example, completely sheathed with a plastic protective sheathing 25 for mechanical protection of the antenna coil 2, and cut into appropriate lengths. The length of the overlap 9 is determined by the length of the coupling conductor 4 that penetrates into the tubular plastic rod 7.

FIGS. 5A and 5B show another particularly advantageous embodiment of the invention. In this embodiment, the coupling conductor 4 is configured as an electrically conductive sleeve 16 that comprises an essentially tubular body having a lid situated at one end. In an exemplary embodiment, the sleeve is lined with an electrically insulating plastic mantle as a low-loss insulator 10 at its inner edge. The insulator surrounds the plastic rod 7 that is introduced into the electrically conductive sleeve 16 with plastic mantle, which carries the antenna coil 2, at least over the length of the overlap 9, with shape fit. At its lower end, the electrically conductive sleeve 16 contains the electromechanical connecting element 14, for a connection to the electromechanical base connector 5 of the plastic base part 3.

FIG. 6A shows another advantageous embodiment which shows a cross-sectional view of a plastic rod 7 that carries the antenna coil 2 and electrically conductive sleeve 16, that is configured with a circular cross-section, in each instance. The low-loss insulator 10 is formed by an insulator sleeve 22, whereby the latter is introduced into the electrically conductive sleeve 16 with shape fit, into which the plastic rod 7 that carries the antenna coil 2 is introduced, in turn, at least over the length of the overlap 9, at its lower end, with shape fit. This view shows an elastic rod core 17, having a rod core sheathing 18 comprising a dielectrically low loss insulating material.

In FIG. 6B, the tubular insulator 21 is configured in the interior of the electrically conductive sleeve 16, whereby an insulation disk 24 is inserted at the lower end, in order to avoid a galvanic contact between the antenna coil 2 and the electrically conductive sleeve 16. If, for design reasons, a very thin wall thickness of the tubular insulator 21 is required, then the tube wall can be provided with perforations, to reduce the coupling capacity, at a predetermined dielectricity constant of the insulator material.

FIG. 6B shows another advantageous embodiment of the invention the plastic rod 7 that carries the antenna coil 2 is formed from a highly elastic rod 26 having an essentially round cross-section and made from glass-fiber-reinforced plastic, to produce the reset force. In order to configure an antenna coil 2 from a wire-shaped conductor 11 having a diameter that is not too small, the diameter of the plastic rod 7 should be selected to be not smaller than 2 mm. This view shows a tubular insulator 21 that comprises a low loss insulator. Surrounding this insulator is coupling conductor 4 forming an electrically conductive sheath along overlap 9. This design also shows electromechanical coupling element 14 as well as which is coupled to insulation disk. This antenna extends along length 13 in a direction of antenna longitudinal axis 8.

FIG. 6C shows an antenna rod 1 that is particularly advantageous for production, wherein low-loss insulator 10 is formed by the material 27 for the plastic protective sheathing 25 itself, which is selected to be insulating in dielectrically low-loss manner. In addition coupled around this sheathing is a plastic coating 19 which is injection molded on which forms a plastic protective sheathing 25. For this purpose, the diameter of the electrically conductive sleeve 16 is accordingly selected to be greater than the diameter of the plastic rod 7 that carries the antenna coil 2. This rod is introduced into the electrically conductive sleeve 16 in such a manner, during production, that the low-loss insulator 10 is formed by the dielectrically low-loss insulating material 27 flowing in between the electrically conductive sleeve 16 and the plastic rod 7 that carries the antenna coil 2. Thus, it is advantageous that injection-molding of the plastic protective sheathing 25 around the antenna rod 1 and production of the low-loss insulator 10 occurs in one work process. This design includes a plastic rod core 17 which is coupled to coupling element 14 as well as which is coupled to insulation disk 24. This antenna extends along length 13 in a direction of antenna longitudinal axis 8.

In a particularly low-effort embodiment of an antenna rod 1 according to at least one embodiment of the invention, the plastic rod 7 and the antenna coil 2 of the antenna rod 1 are formed from one part, in such a manner that the wire-shaped conductor 11 is applied to both sides of an extended, imprinted circuit board 23, as a printed circuit track 28. FIG. 7*a* shows an antenna coil 2 as a printed circuit track 28 on both sides of an extended printed circuit board 23 as a plastic rod 7, in a perspective representation. The sections of the printed circuit tracks assigned to one another on both sides are conductively connected with one another using interlayer connections 31, to form the antenna coil 2. The coupling conductor 4, which is structured as a printed circuit track 28, is capacitively coupled with the interlayer connections 31, so-called via holes. The thickness of the conductor plate is selected to be appropriately great, to achieve a sufficiently large cross-sectional area of the antenna coil 2 formed in this way.

In FIG. 7B, an interdigital structure 30 is formed in order to increase the capacitance that exists between the coupling conductor 4 and the windings of the antenna coil 2 formed in this manner. This structure is formed in that short, narrow, printed conductor tracks, essentially guided parallel to one another, are added to the printed circuit track 28 of the coupling conductor, which tracks are disposed interdigitally between the conductor parts of the antenna coil 2, which are also guided essentially parallel to one another. In this way, capacitive coupling between the conductor parts of the coupling conductor 4, which are disposed interdigitally relative to one another, and the antenna coil 2 is provided. FIG. 7*c* shows a side view of the antenna rod 1, in order to illustrate the electromechanical connecting element 14 for attachment to the electromechanical base connector 5 of the plastic base part 3.

In the interests of a greater bandwidth of the frequency-response-curve of the impedance 33 of the antenna rod 1 connected to the electromechanical base connector 5, measured against ground 29, in the frequency range of USW radio, an additional coupling coil 32—as indicated in FIG. 8*a*—is applied to the plastic rod 7 (the plastic rod 7 itself is not shown, for reasons of a clear illustration). In a simple embodiment, this coupling coil 32, for example made of wire, can be applied to a tubular body that is pushed over the antenna coil 2. Such an arrangement allows configuring the frequency-response-curve of the impedance 33 in accordance with that of a two-circuit resonance band filter, as shown in FIG. 8*b*. The increase in size of the bandwidth results from the configuration of the loop in the complex impedance plane, which can be achieved by means of suitable coordination of the two coils 2 and 32 with reference to the geometry of the two coils together with the dielectrical properties of the materials. In this connection, the coil overlap 34—this is the length over which the antenna coil 2 is covered by the coupling coil 32—should not be less than ¼ of the antenna coil 2.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention an in particular, in the context of the following claims are to be construed to cover both the singular and the plural, unless otherwise specified herein or clearly contradicted by context. The terms "comprising," "having," "including," and "containing" are to be construed as open-ended terms for example, meaning "including, but not limited to," unless otherwise stated. The terms "connected" or "coupled" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims.

Thus, it is intended that the present invention cover the modifications and variations of this invention provided they come within the scope of the appended claims and their equivalents.

REFERENCE SYMBOL LIST

Antenna rod 1
Antenna coil 2
Plastic base part 3
Coupling conductor 4
Electromechanical base connector 5
Further antenna circuit 6
Plastic rod 7
Rod axis 8
Overlap 9
Low-loss insulator 10
Wire-shaped conductor 11
Vehicle body 12
Antenna rod length 13
Electromechanical connecting element 14
Length of coupling conductor 15
Electrically conductive sleeve 16
Elastic rod core 17
Rod core sheathing 18
Plastic coating, injection-molded on, 19
Insulator bushing 20
Tubular insulator 21
Insulator sleeve 22
Conductor plate 23
Insulation disk 24
Plastic protective sheathing 25
Highly elastic rod 26
Dielectrically low-loss insulating material 27
Printed circuit track 28
Ground 29
Interdigital structure 30
Interlayer connection 31
Coupling coil 32
Impedance 33
Coil overlap 34
Parallel oscillating circuit 35

What is claimed is:

1. An antenna rod for a rod antenna arrangement on a vehicle body serving as a ground, said antenna comprising:

a base connector configured to form an electromechanical connection to the vehicle body;

a base part coupled to the vehicle body;

an antenna circuit disposed in said base part, wherein said base connector is configured to form a mechanical connection to said base part, and an electromechanical connection to said antenna circuit;

a plastic rod, having a rod axis;

an antenna coil coupled to said plastic rod;

a coupling conductor coupled to a lower end of the plastic rod and parallel to its rod axis, said coupling conductor configured for electromagnetic coupling to said antenna coil, said coupling conductor forming an overlap comprising at least two windings of the antenna coil, formed by said coupling of said coupling conductor and said antenna coil;

an insulator, wherein said coupling conductor is galvanically separated from said antenna coil by means of said insulator, to create capacitative coupling of said coupling conductor to said antenna coil, wherein said coupling conductor, the insulator, and said plastic antenna rod are coupled to each other; and an electromechanical connecting element, coupled to said coupling conductor for connecting to said base connector, wherein said coupling conductor is configured as an electrically conductive sleeve, comprising said insulator acting as a low loss insulator, wherein said electrically conductive sleeve is lined with said low loss insulator acting as an electrically insulating plastic mantle, and being disposed at its inner edge, wherein said insulator surrounds said plastic rod that is introduced into said electrically conductive sleeve with said plastic mantle, and wherein said plastic rod carries said antenna coil, at least over a length of said overlap, with shape fit, and said electrically conductive sleeve contains an electromechanical connecting element at its lower end.

2. The antenna rod of claim 1, wherein said plastic antenna rod has a length that is shorter than 45 cm, wherein said antenna coil is configured from a wire-shaped conductor wound on the plastic rod at an essentially constant pitch, wherein a diameter, and a pitch of a set of windings of said antenna coil, and a diameter of said wire-shaped conductor of said antenna coil, are coordinated with one another, for operation in a ultra short wave (USW) range, so that an impedance of said antenna rod connected with said electromechanical base connector, measured against ground, passes through a resonance in a frequency range between 75 MHz and 120 MHz, and wherein said overlap is selected to be between 2 cm and 6 cm such that said insulator that mechanically connects said coupling conductor with said antenna rod is selected so that a static capacitance between said coupling conductor and said antenna spiral amounts to at least 3 pF wherein the antenna is configured as a rod antenna arrangement for reception of AM/FM.

3. The antenna rod for a rod antenna arrangement of claim 2, further comprising:

a parallel oscillating circuit having a parallel resonance frequency between 120 MHz and 160 MHz which is disposed at an input of said further antenna circuit, wherein said circuit is connected with said electromechanical base connector, wherein a diameter, a pitch of the windings, and a diameter of said wire-shaped conductor of said antenna coil are coordinated with one another, so that an impedance measured at the other connector of the parallel oscillating circuit, against ground, passes through a first low-ohm resonance in a frequency range between 75 MHz and 110 MHz, for operation in the USW frequency range, and through a second low-ohm resonance in the frequency range between 175 MHz and 240 MHz, for operation in the VHF frequency range.

4. The antenna rod of claim 3, wherein a length of said coupling conductor for reception of a radio service in a L frequency band amounts to about ¼ of the free-space wavelength of a frequency of a radio service such that the antenna arrangement is configured for reception of AM/FM/VHF and a radio service in an L band.

5. The antenna rod of claim 2, wherein a length of said coupling conductor for reception of a radio service in a L frequency band is configured to be about ¼ of a free-space wavelength of the frequency of the radio service so that the antenna arrangement is configured for reception of AM/FM and a radio service in a L band.

6. The antenna rod (1) for a rod antenna arrangement for reception of the AM/FM and the VHF radio band according to claim 2, wherein said antenna is configured for reception of a radio service in the L band, wherein said antenna further comprises:

a capacitor connected with the electromechanical base connector (5) with its first connector having a capacitance value between 5 pF and 20 pF; and an inductor having an inductance value between 500 nH and 1500 nH, which is connected between its second connector and said ground (29), wherein a diameter, a pitch of the windings, and a diameter of said wire-shaped connector (11) of said antenna coil (2) are tuned with one another so that an impedance measured parallel to said inductance passes through a low-ohm resonance in a frequency range between 190 MHz and 230 MHz.

7. The antenna rod of claim 1, wherein said plastic rod has a cross-section that is configured essentially as a rectangle, and wherein said coupling conductor is configured as a strip conductor, which, together with said insulator that lies in between, is firmly mechanically connected with said plastic rod that carries said antenna coil.

8. The antenna rod of claim 1, wherein said plastic rod, in its lower section, is configured to be tubular at least over the length of said overlap, wherein said coupling conductor is configured in a shape of a round rod; and wherein said coupling conductor is introduced into said plastic rod that is configured to be tubular, and mechanically connected with said coupling conductor, and connected with said electromechanical connecting element at its lower end.

9. The antenna rod of claim 1, wherein said plastic rod that carries said antenna coil and said electrically conductive sleeve are configured with a circular cross-section, in each instance, wherein the antenna rod further comprises:

an insulator sleeve having a minimum length of said overlap, wherein said plastic rod is inserted into said insulator sleeve so that it carries said antenna coil with shape fit, at its lower end, and this in turn is inserted, with shape fit, into said electrically conductive sleeve.

10. The antenna rod of claim 1, further comprising:

a tubular insulator; and an insulation disk disposed in an interior of said electrically conductive sleeve, at its lower end, said insulation disk being configured to avoid galvanic contact between said antenna coil and said electrically conductive sleeve.

11. The antenna rod of claim 1, wherein said plastic rod that carries the antenna coil comprises:

a highly elastic rod having an essentially round cross-section, made of glass-fiber-reinforced plastic, to form a reset force, a diameter of which is selected to be at least 2 mm, and on which the antenna coil is applied.

12. The antenna rod of claim 1, wherein said plastic rod that carries said antenna coil comprises:

an elastic rod having small cross-sectional dimensions, made of glass-fiber-reinforced plastic, to form a reset force, which rod is surrounded by a rod core sheathing made of a softer, dielectrically low-loss insulating material, to configure a suitable cross-section for application of said antenna coil.

13. The antenna rod of claim 12 wherein, said antenna rod is selected to have a round cross-section;

an antenna rod length is selected to be at least 150 mm, a diameter of the highly elastic rod made of glass-fiber-reinforced plastic which is selected to be about 2 to 3 mm;

a diameter of the rod core sheathing is selected to be about 4 to 8 mm, said overlap; and a length of the coupling conductor is selected to be about 30 to 50 mm.

14. The antenna rod of claim 1, further comprising:

a plastic protective sheathing configured for mechanical protection of said antenna coil, wherein said plastic rod that carries said antenna coil is surrounded by said plastic protective sheathing.

15. The antenna rod of claim 14, wherein said the low-loss insulator is formed by the material for said plastic protective sheathing, wherein said material is selected to be dielectrically low-loss and insulating, whereby the diameter of said electrically conductive sleeve is selected to be correspondingly greater than the diameter of the plastic rod that carries said antenna coil, and said plastic rod is introduced into the electrically conductive sleeve during production, so that said low-loss insulator is formed by flow of said dielectrically low-loss insulating material in between said electrically conductive sleeve and the plastic rod that carries said antenna coil, when said plastic protective sheathing is injection-molded around the antenna rod.

16. The antenna rod (1) as in claim 1, wherein said plastic rod (7) is formed from a printed circuit board (23);

said antenna coil (2) of said antenna rod (1) is formed with said plastic rod (7) as a single part;

wherein said antenna coil (2) is formed as a wire-shaped conductor (11) and which is formed on both sides of said extended printed circuit board (23), wherein said wire-shaped conductor comprises:

a plurality of printed circuit tracks (28); and at least one interlayer connection (31) wherein sections of said printed circuit tracks that are assigned to one another on the two sides are conductively connected with one another using said at least one interlayer connection (31), wherein said plastic rod is configured to have holes, and a thickness of said circuit board is selected to be sufficiently large, so as to extend substantially across a cross-sectional area of the antenna coil.

17. The antenna rod (1) according to claim 1, wherein said plastic rod (7) is formed as a circuit board (23);

wherein said coupling conductor (4) for producing the coupling capacitance is configured on at least one side of said circuit board (23), as a printed circuit track (28);

wherein the rod further comprises:

an interdigital structure (30) having a length of said overlap (9), formed from said printed circuit track (28) together with a set of printed circuit tracks of the antenna coil (2);

wherein said coupling conductor (4), which is disposed at its lower end, is electrically connected with said electromechanical connecting element (14), which is mechanically firmly connected with said circuit board (23).

18. The antenna rod (1) as in claim 1, further comprising a coupling coil (32) configured to provide electromagnetic coupling to said antenna coil (2), wherein said coupling coil (32) is coupled to said plastic rod (7), wherein said coupling coil (32) covers said antenna coil (2) with a coil overlap (34) of at least ¼ of a length of said antenna coil (2), wherein said coupling coil (32) is galvanically separated from said antenna coil (2), and both coils (2, 32) are tuned to one another so that a frequency-responsive-curve of an impedance of said antenna rod (1) connected with said electromechanical base connector (5), measured against ground (29), forms a broad-band loop in the frequency range of USW radio, in a complex impedance plane, and thus corresponds to that of a two-circuit resonance band filter.

* * * * *